US010488058B2

(12) United States Patent
Kwon et al.

(10) Patent No.: US 10,488,058 B2
(45) Date of Patent: Nov. 26, 2019

(54) OUTDOOR DEVICE OF AN AIR CONDITIONER

(71) Applicant: LG ELECTRONICS INC., Seoul (KR)

(72) Inventors: Sangyoung Kwon, Seoul (KR); Jaewan Lee, Seoul (KR); Kyomin Koo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 954 days.

(21) Appl. No.: 14/985,886

(22) Filed: Dec. 31, 2015

(65) Prior Publication Data

US 2016/0187005 A1 Jun. 30, 2016

(30) Foreign Application Priority Data

Dec. 31, 2014 (KR) ..... 10-2014-0196034

(51) Int. Cl.

| | |
|---|---|
| ***F25D 23/00*** | (2006.01) |
| ***F24F 1/38*** | (2011.01) |
| ***F24F 1/50*** | (2011.01) |
| ***F24F 1/56*** | (2011.01) |
| ***F24F 1/40*** | (2011.01) |

(52) U.S. Cl.

CPC ..... *F24F 1/38* (2013.01); *F24F 1/40* (2013.01); *F24F 1/50* (2013.01); *F24F 1/56* (2013.01)

(58) Field of Classification Search

CPC ..... F24F 1/22; F24F 1/38; F24F 1/40; F24F 1/50

See application file for complete search history.

(56) References Cited

U.S. PATENT DOCUMENTS

| | | | | |
|---|---|---|---|---|
| 9,062,888 | B2 | 6/2015 | Tadokoro et al. | |
| 2009/0193831 | A1* | 8/2009 | Kim | F04D 29/526 62/259.1 |
| 2010/0269537 | A1 | 10/2010 | Tadokoro et al. | |
| 2013/0125579 | A1 | 5/2013 | Okazawa | |

(Continued)

FOREIGN PATENT DOCUMENTS

| | | |
|---|---|---|
| CN | 101925783 | 12/2010 |
| CN | 102859287 | 1/2013 |

(Continued)

OTHER PUBLICATIONS

Chinese Office Action (with English Translation) dated Feb. 27, 2018 issued in Chinese Application No. 201510882732.2.

(Continued)

*Primary Examiner* — Kayla Mccaffrey
(74) *Attorney, Agent, or Firm* — Ked & Associates, LLP

(57) ABSTRACT

An outdoor device of an air conditioner is provided and may include a top cover that forms an upper surface of the outdoor device and provided with at least one discharge port through which air may be discharged, at least one fan provided under the top cover, and at least one shroud that accommodates the fan and that connects with the discharge port. A transverse width of the at least one shroud that passes through side surfaces of the at least one shroud and the at least one fan may be constant from an inlet port of the shroud to an outlet part. A cross sectional area of the outlet part may gradually increase toward the at least one discharge port.

26 Claims, 15 Drawing Sheets

(56) References Cited

U.S. PATENT DOCUMENTS

| | | | | |
|---|---|---|---|---|
| 2014/0298844 | A1* | 10/2014 | Luo | F24F 1/36 62/275 |
| 2015/0184872 | A1 | 7/2015 | Oh et al. | |

FOREIGN PATENT DOCUMENTS

| | | | |
|---|---|---|---|
| CN | 202835597 | * | 3/2013 |
| CN | 103097821 | | 5/2013 |
| CN | 104040263 | | 9/2014 |
| EP | 2 233 847 | | 9/2010 |
| EP | 2 565 546 | | 3/2013 |
| EP | 2 889 544 | | 7/2015 |
| JP | 2003-214660 | | 7/2003 |
| KR | 10-2013008843 | A | 8/2013 |
| WO | WO 2013/108519 | | 7/2013 |

OTHER PUBLICATIONS

European Search Report dated May 9, 2016 issued in Application No. 15203090.4.

* cited by examiner

OUTDOOR DEVICE OF AN AIR CONDITIONER

CROSS-REFERENCE TO RELATED APPLICATION

This application claims priority under 35 U.S.C. § 119 to Korean Application No. 10-2014-0196034, filed in Korea on Dec. 31, 2014, whose entire disclosure is incorporated herein by reference.

BACKGROUND

1. Field

An outdoor device of an air conditioner is disclosed herein.

2. Background

An air conditioner is a home appliance that maintains indoor air in an optimal state according to its uses and purposes. For example, an interior space may be controlled to be cool in summer and controlled to be warm in winter. Indoor humidity may also be controlled, and the indoor air may be kept fresh and clean.

The air conditioner may be driven by a refrigeration cycle in which compression, condensation, expansion and evaporation of a refrigerant may be performed. Thus, an indoor space may be cooled or warmed.

Based on whether an indoor unit or device and an outdoor unit or device are separated or integrated, the air conditioner may be classified as a separated-type air conditioner in which the indoor unit and the outdoor unit are separated from each other and an integrated-type air conditioner in which the indoor unit and the outdoor unit are integrated in one unit. The outdoor unit may include an outdoor heat exchanger that heat exchanges with external air, and the indoor unit may include an indoor heat exchanger that heat exchanges with indoor air.

When the refrigeration cycle performs a cooling operation, the outdoor heat exchanger may serve as a condenser, and the indoor heat exchanger may serve as an evaporator. When the refrigeration cycle performs a warming operation, the indoor heat exchanger may serve as the condenser, and the outdoor heat exchanger may serve as the evaporator.

A widely used, multi-type air conditioner may have a refrigerant circuit in which a plurality of outdoor units or devices may be disposed or provided outside, for example, on a rooftop of a building, and a plurality of indoor units or devices respectively connected with the outdoor units to independently cool or warm each indoor space.

Korean Unexamined Patent Application Publication No. 10-2013-0088434, which is hereby incorporated by reference, provides an outdoor unit of a multi-type air conditioner. In the outdoor unit of the air conditioner, each element forming the refrigeration cycle, for example, a compressor, may be installed on an upper surface of a base pan. An outdoor heat exchanger may be disposed or provided along a circumference of the base pan to be exposed to three surfaces. A left panel and a right panel, each of which may have an inlet port, may be formed at left and right sides of the outdoor heat exchanger. A suction grille may also be provided at a rear surface of the outdoor heat exchanger to allow external air to pass through.

A fan may be provided at an internal upper portion of the outdoor unit so that outdoor air may pass through the outdoor heat exchanger and then may be discharged upward. The fan may be provided inside a shroud to guide air discharged.

However, in the outdoor unit according to the related art, a constant pressure of the air passing through the shroud may be reduced by friction. Thus, a flow rate may be reduced, and noise may increase.

BRIEF DESCRIPTION OF THE DRAWINGS

Embodiments will be described in detail with reference to the following drawings in which like reference numerals refer to like elements, and wherein.

DETAILED DESCRIPTION

Figure 1:
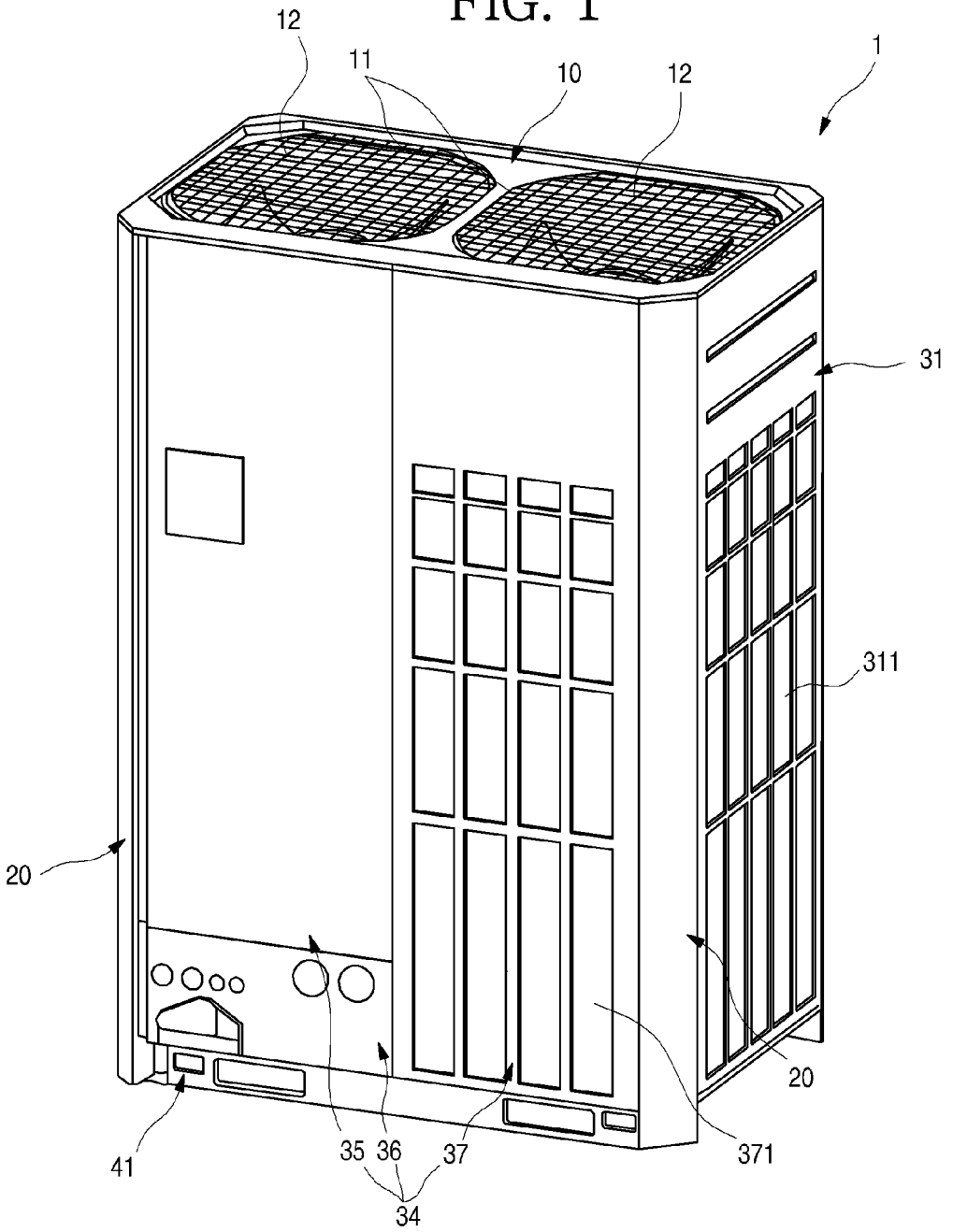
FIG. 1 is a perspective view of an outdoor device of an air conditioner according to an embodiment.
Figure 2:
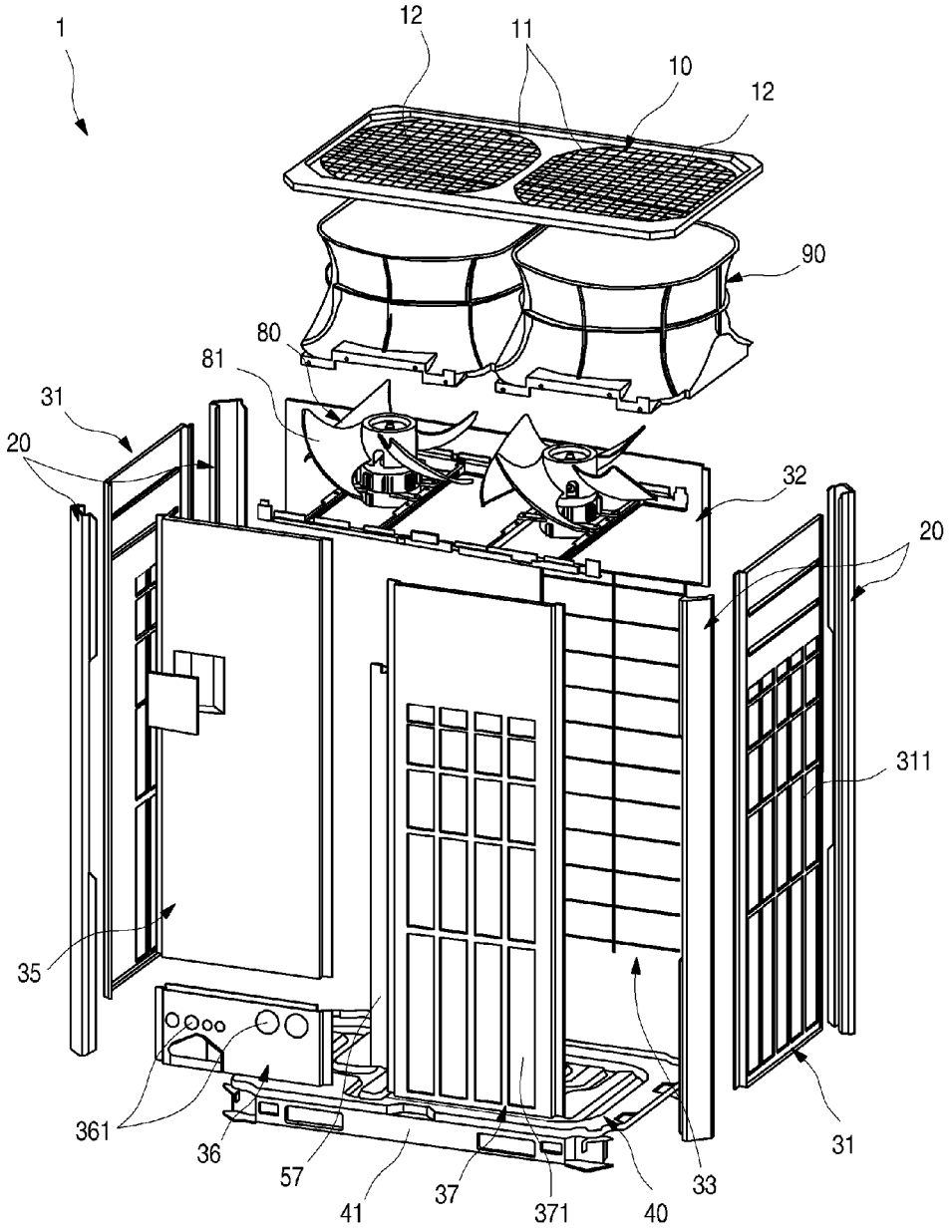
FIG. 2 is an exploded perspective view of a coupling structure among elements that may form an external appearance of the outdoor device of FIG. 1.
Figure 3:
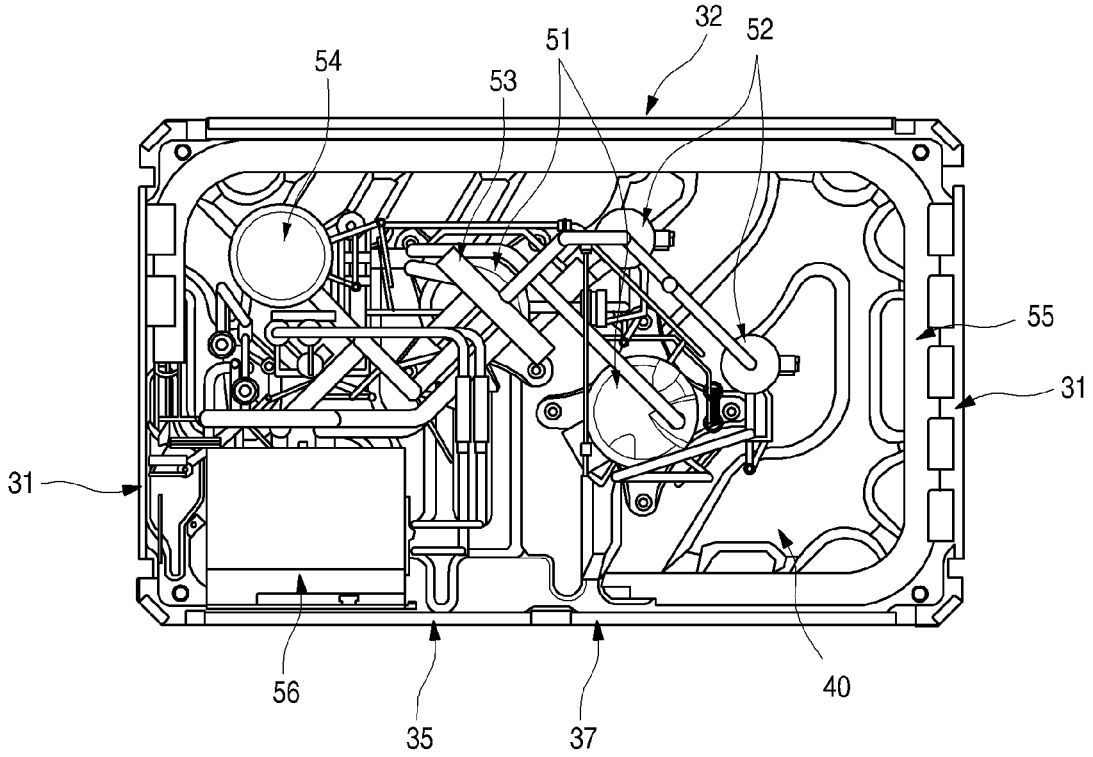
FIG. 3 is a plan view of an inside of the outdoor device of FIG. 1.

FIG. 1 is a perspective view of an outdoor device of an air conditioner according to an embodiment. FIG. 2 is an exploded perspective view of a coupling structure among elements that form an external appearance of the outdoor device of FIG. 1. FIG. 3 is a plan view of an inside of the outdoor device of FIG. 1.

An air conditioner according to embodiments disclosed herein may include an outdoor unit or device 1, which may be provided outdoors, and an indoor unit or device, which may be connected with the outdoor device 1 via a refrigerant pipe and may be provided indoors. The indoor device may include an indoor heat exchanger that heat-exchanges indoor air.

A top cover 10, a plurality of outer panels, a base pan 40, and a plurality of side supporters may form an external shape of the outdoor device 1. For example, the top cover 10 may be provided on and may form an external shape of an upper surface of the outdoor device 1. A pair of discharge ports 11 may be formed at the top cover 10 and may enable heat-exchanged air from an inside of the outdoor device 1 to be discharged outside of the outdoor device 1. A discharge grille 12 may be provided at each of the pair of discharge ports 11 to prevent external foreign substances from being introduced through the pair of discharge ports 11.

The plurality of side supporter 20 may be provided at or on corners of the outdoor device 1. Each side supporter 20 may be bent, may connect the top cover 10 to the base pan 40, and may form a corner of the outdoor device 1. Each side supporter 20 may be in a pipe shape. The outer panels may be provided between the side supporters 20, and may form an external appearance of an outer surface of the outdoor device 1.

The plurality of outer panels may include a pair of side panels 31 that form left and right side or first and second surfaces of the outdoor device 1, a front panel 34 that form a front surface of the outdoor device 1, and a rear panel 32 that form a rear surface of the outdoor device 1. For example, the pair of side panels 31 that form the first and second side surfaces of the outdoor device 1 may be in a plate shape that connects to the side supporters 20, the base pan 40, and the top cover 10.

An upper portion of each side panel 31, for example, an area that corresponds to one or more shroud 90 in the outdoor device 1, may be solid. A plurality of suction ports 311 may be formed at a lower portion of the side panel 31 that does not form the solid area. The plurality of suction ports 311 may be uniformly formed in an area in which an outdoor heat exchanger 55 may be located and may serve to guide suctioned air to pass through the outdoor heat exchanger 55.

An arrangement of the plurality of suction ports 311 formed in the side panel 31 may also be changed based on a structure and arrangement of the outdoor heat exchanger 55. For example, the plurality of suction ports 311 may be arranged at or in an area that corresponds to the outdoor heat exchanger 55 while other areas that may not correspond to the outdoor heat exchanger 55 may be solid. Thus, all of the suctioned air may pass through the outdoor heat exchanger 55.

The rear panel 32 may be provided at a rear surface of the outdoor device 1 that corresponds to a position of the one or more shroud 90. A suction grille 33 may be provided that extends from a lower end of the rear panel 32 to the base pan 40. The suction grille 33 may be formed by a plurality of wires in a lattice shape and may also have a size that corresponds to the outdoor heat exchanger 55 located at the rear surface of the outdoor device 1. Thus, the suction grille 33 may protect the outdoor heat exchanger 55 from external impact or foreign substances and may also allow external air to be introduced smoothly therethrough.

A plurality of front panels 34 may be provided at a front surface of the outdoor device 1. The plurality of front panels 34 may include a service panel 35, a piping panel 36 and a suction panel 37. For example, the front surface of the outdoor device 1 may be divided into left and right or first and second sides based on a point from which the outdoor heat exchanger 55 may extend. That is, the service panel 35 and the piping panel 36 may be provided at the first side of the outdoor device 1, and the suction panel 37 may be provided at the second side of the outdoor device 1.

The service panel 35 may be provided at a position on the first side of the outdoor device 1 that corresponds to an end of the outdoor heat exchanger 55. The service panel 35 may be independently separable from the other front panels 34. Thus, separating the service panel 35 may allow access to internal components of the outdoor device 1.

For example, when the service panel 35 is opened, a control box 56 may be exposed and may allow easy access to components that form a refrigeration cycle and a refrigerant pipe that may connect the components.

The piping panel 36 outdoor device may be provided between a lower end of the service panel 35 and the base pan 40. The piping panel 36 may allow for an indoor device connection pipe that connects the outdoor device 1 with the indoor device to pass through the piping panel 36 and may fix the indoor device connection pipe thereto. The piping panel 36 may have a same width as a width of the service panel 35 and may also allow the service panel 35 to be separated if the piping panel 36 is provided at the base pan 40.

A pipe installation hole 361, through which a plurality of indoor device connection pipes connected with the indoor device may pass, may be formed at or in the piping panel 36. A service valve may be installed at or in the pipe installation hole 361 to enable the indoor device connection pipes to be easily connected and installed. The piping panel 36 may be integrally formed with the service panel 35; however the embodiments are not limited thereto.

The suction panel 37 may form a remaining front surface of the outdoor device 1 not formed by the service panel 35 and the piping panel 36. The suction panel 37 may extend from the top cover 10 to the base pan 40 and may extend from the side supporter 20 to the service panel 35 and the piping panel 36.

The suction panel 37 may extend to an end of the outdoor heat exchanger 55. The suction panel 37 may be provided inside of the outdoor device 1 so that a coupling plate 57, to which the end of the outdoor heat exchanger 55 may be fixed, may be coupled with an end of the suction panel 37. Thus, the outdoor heat exchanger 55 may be stably fixed by the suction panel 37.

The suction panel 37 may also be formed so that an upper portion that corresponds to the position of the one or more shroud 90 may be solid. A plurality of suction ports 371 may be formed in a remaining area that corresponds to an area of the outdoor heat exchanger 55 and may enable the external air to flow toward the outdoor heat exchanger 55.

The base pan 40 may form a lower surface of the outdoor device 1. The outdoor device 1 may be supported by a base frame 41, which may be spaced apart from a surface, such as a floor. Components forming a refrigeration cycle, for example, one or more compressor 51 and the outdoor heat exchanger 55, may be provided at or on an upper surface of the base pan 40.

For example, the one or more compressor 51 may be provided on an upper surface of the base frame 41. The one or more compressor 51 may enable a gaseous refrigerant to be compressed to a high temperature and high pressure state. The one or more compressor 51 may include a constant speed compressor that rotates at a constant speed and that performs a compression operation with a constant capacity. The one or more compressor 51 may also include an inverter compressor, a rotational speed of which may be varied according to a load and a compression capacity may be adjustable.

One or more oil separator 52 that separates oil contained in the refrigerant discharged from the one or more compressor 51 may be provided at a refrigerant pipe, which may be connected with an outlet port of each compressor 51. Thus, the oil in the refrigerant may be separated and then recovered again into the respective compressor 51.

A four-way valve 53, which may enable the refrigerant from the oil separator 52 to be selectively supplied to an indoor heat exchanger and the outdoor heat exchanger 55, may be provided at a side of the outdoor device 1. The four-way valve 53 may be connected to the indoor heat exchanger, the outdoor heat exchanger 55, the one or more compressor 51, and an accumulator 54, respectively. The four-way valve 53 may switch paths so that the refrigerant discharged from the one or more compressor 51 may be selectively supplied to the indoor heat exchanger 55 and the outdoor heat exchanger 55 according to a warming operation or a cooling operation.

The accumulator 54 may be provided at a side of the base pan 40 to be connected with the indoor heat exchanger and the four-way valve 53. The accumulator 54 may separate a liquefied refrigerant from the gaseous refrigerant and may enable the liquefied refrigerant to be stored and the gaseous refrigerant to be supplied to the one or more compressor 51.

The outdoor heat exchanger 55, in which the external air may be heat-exchanged with refrigerant, may enable the external air to be heat-exchanged with the refrigerant while the external air is forcibly passed through the outdoor heat exchanger 55 by one or more fan 81. The outdoor heat exchanger 55 may be provided along a perimeter of the base pan 40 and may be arranged along four surfaces of the outdoor device 1. Ends of the outdoor heat exchanger 55 may be spaced apart from each other at a corner formed by a left or first surface and the front surface of the outdoor device 1 and may form a predetermined space. A space between the ends of the outdoor heat exchanger 55 may be opened when the service panel 35 is separated. The space may allow access to various pipes and components that form the refrigeration cycle and the control box 56.

The outdoor heat exchanger 55 may extend from the base pan 40 to a height close to the one or more fan 81. Thus, the outdoor heat exchanger 55 may cover the suction ports 311 and 371 at the inside of the outdoor device 1. The outdoor heat exchanger 55 may also allow all of the air passing through the plurality of suction ports 311 and 371 to pass through the outdoor heat exchanger 55.

The one or more shroud 90 may be installed at an upper portion of the inside of the outdoor device 1, and one or more fan motor assembly 80 may be provided at an inside of the one or more shroud 90, respectively. Each shroud 90 may serves to guide air discharged and may open vertically. A side surface of each shroud 90 may be rounded such that a center of the shroud 90 is recessed inward. An opening of the shroud 90 may gradually widen upward from the center. An open upper surface of the shroud 90 may have a same shape as a shape of the discharge port 11, and the air discharged may be effectively guided to the discharge port 11.

Figure 4:
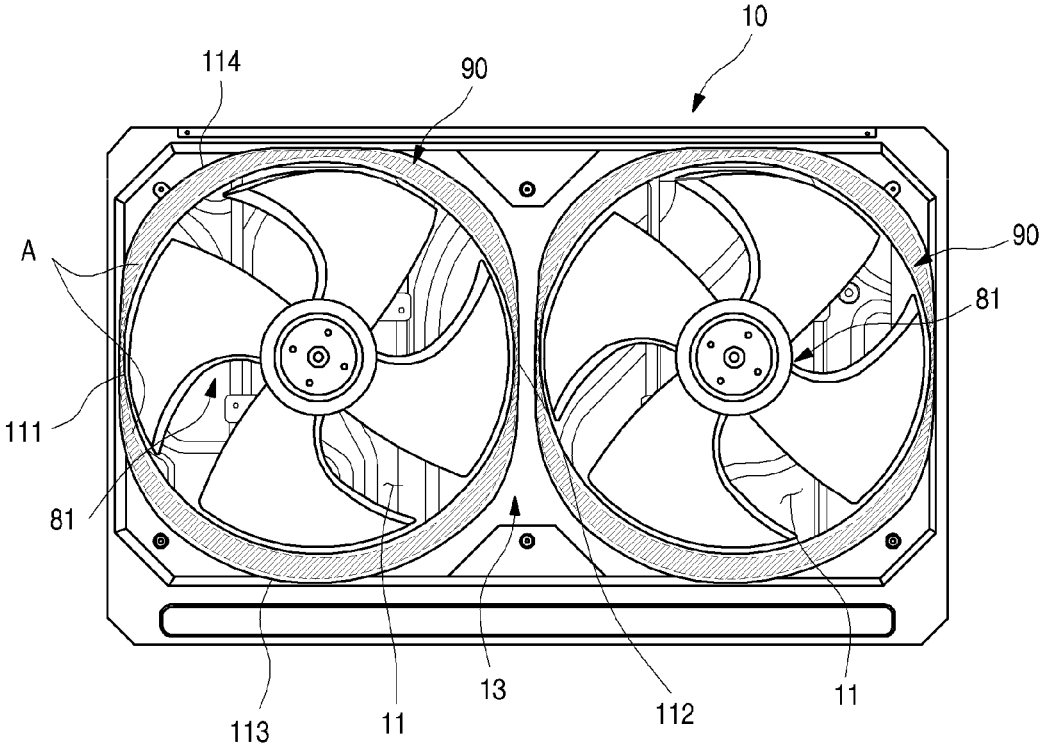
FIG. 4 is a plan view of the outdoor device of FIG. 1 in which a discharge grille is removed.

FIG. 4 is a plan view of the outdoor device of FIG. 1, in which a discharge grille outdoor device is removed. The top cover 10 may form the upper surface of the outdoor device 1. The top cover 10 may be coupled with an upper end of each of the plurality of outer panels that forms a perimeter of the outdoor device 1.

For example, the top cover 10 may have a flat surface that forms the upper surface of the outdoor device 1, and an edge that may be bent downward at the perimeter of the outdoor device 1. A recessed portion 13 may be provided at an upper surface of the top cover 10. The recessed portion 13 may include an area at or in which the plurality of discharge ports 11 may be formed, and an outer area adjacent to the plurality of discharge ports 11. The recessed portion 13 may form the flat surface and may be formed by recessing a portion of the upper surface of the top cover 10 that does not form an edge thereof.

The discharge grille 12 may be installed at the recessed portion 13. The discharge grille 12 may cover the plurality of discharge port 11 and may be a plurality of wires in a lattice shape or a net structure. The discharge grille 12 may cover all of the plurality of discharge ports 11 or may be separately formed and installed to cover each discharge port 11. Each discharge port 11 may be inside of the recessed portion 13 and may be provided under an upper end of the top cover 10. Each discharge port 11 may be hidden by the edge of the top cover 10 if viewing the outdoor device 1 from a front side.

Each discharge port 11 may be a same shape as a shape of the open upper surface of the respective shroud 90, and the discharge port 11 may be in contact with the respective shroud 90. Thus, air guided by the shroud 90 may be discharged through the discharge port 11.

Each discharge port 11 may have a size that corresponds to a size of an outlet port of the respective shroud 90. The discharge port 11 may be formed in an area of the top cover 10 that corresponds to a size of an outlet port 92 of the respective shroud 90 within a range based on the top cover 10. For example, when each of a pair of fan motor assemblies 80 and shrouds 90 are formed, the discharge ports 11 may be provided so as to not interfere with each other. That is, the discharge ports 11 may be arranged parallel to each other where one discharge port 11 is on a left or first or right or second side of another discharge port 11. As the top cover 10 may have a limited size and the discharge ports 11 may be provided at or on the top cover 10, a size and shape of the discharge ports 11 may also be limited. Further, as the size and shape of each of the discharge ports 11 may be the same as the size and shape of the outlet port 92 of the shroud 90, the size and shape of the discharge ports 11 may influence a shape of the shroud 90.

If the discharge ports 11 are arranged to be in parallel at left and right or first and second sides, to not overlap with each other, and to not overlap with a side end of the top cover 10, then each of the discharge ports 11 may be formed as large as possible within a predetermined range. A horizontal length of the discharge port 11 that passes through a center of the discharge port 11 may correspond to a diameter of the respective fan 81.

According to embodiments disclosed herein, sides 111 and 112 of the discharge port 11 that correspond to left and right or first and second side surfaces of the top cover 10 may have a same width as each other. A front half 113 and a rear half 114 of the discharge port 11 that correspond to a front end and a rear end, respectively, of the top cover 10 may be rounded. For example, as the front half 113 may be further away from the front end of the top cover 10 due to a structural characteristic when the fan 81 is installed, the front half 113 may be more rounded than the rear half 114. An area of the top cover 10 in which the discharge port 11 or the fan 81 may have little influence on size and shape, for example, an area close to a corner of the recessed portion 13, may be formed to have a curvature.

The above described shape of the top cover 10 may affect the shape of the outlet port 92 of the shroud 90. The fan 81 may further influence a size of a middle of the shroud 90 at which the fan 81 may be located. A remaining area A may be formed to be rounded outward so an expanded air pathway may be provided.

Figure 5:
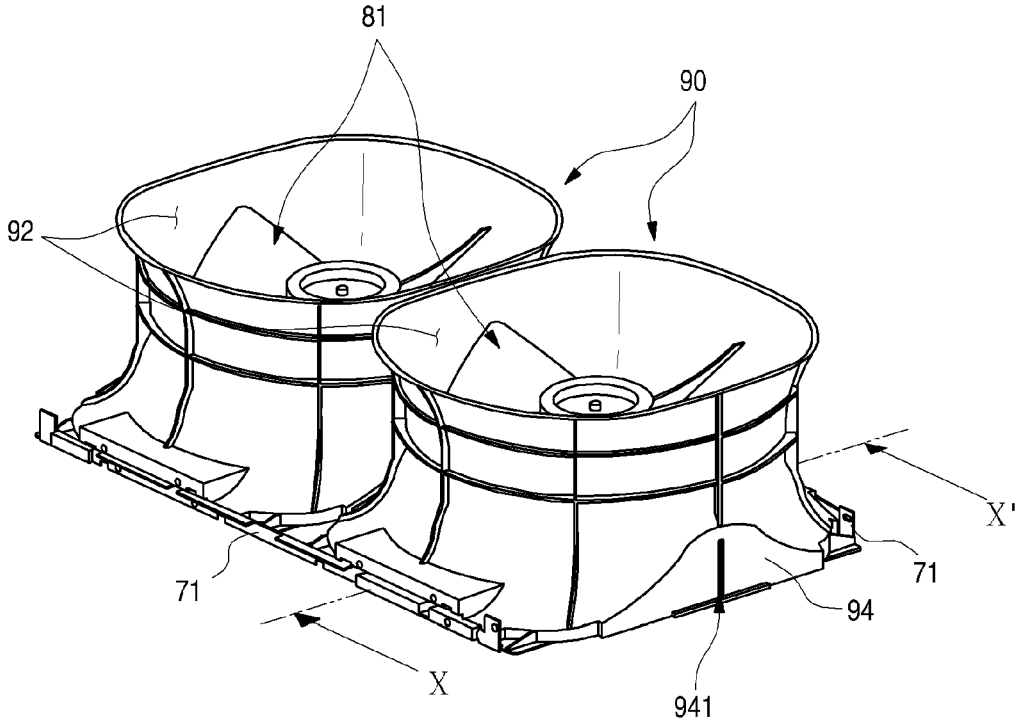
FIG. 5 is a perspective view in which a shroud and a fan motor assembly are coupled according to an embodiment.
Figure 6:
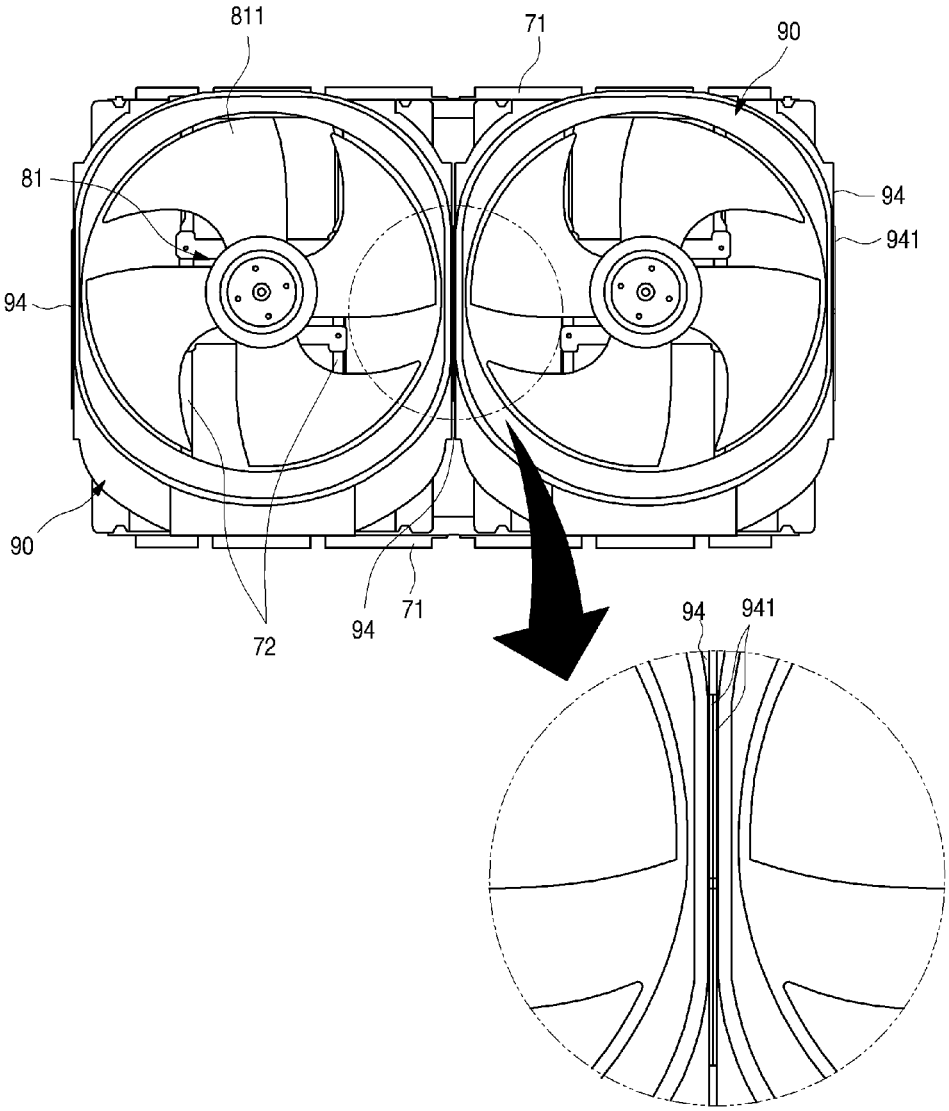
FIG. 6 is a plan view in which the shroud and the fan motor assembly are coupled.

FIG. 5 is a perspective view in which a shroud and a fan motor assembly are coupled according to an embodiment. FIG. 6 is a plan view in which the shroud and the fan motor assembly are coupled.

The pair of fan motor assemblies 80 and the pair of shrouds 90 may be arranged so that a fan motor assembly 80 and a shroud 90 may be provided on the left or first side and another fan motor assembly 80 and another shroud 90 may be provided on the right or second side. The pair of fan motor assemblies 80 and the pair of shrouds 90 may be provided to effectively use a space of the outdoor device 1.

The front end and a rear end of each shroud 90 may be fixed or attached to a pair of chassis frames 71. The pair of chassis frames 71 may be coupled to inner side surfaces of the front panel 34 and the rear panel 32, respectively, and may be provided above the outdoor heat exchanger 55. Thus, the front end and the rear end of each shroud 90 may be in contact with the front panel 34 and the rear panel 32, respectively.

Also, an end of one shroud of the pair of shrouds 90 may be in close contact with an inner side surface of the side panel 31 that forms a first side surface of the outdoor device 1. An end of another shroud of the pair of shrouds 90 may be in close contact with an inner side surface of the side panel 31 that forms a second side surface of the outdoor device 1. The pair of shrouds 90 may be arranged so that side surfaces of each of the shrouds 90 may be in close contact with each other.

The pair of shrouds 90 may be installed at an internal upper portion of the outdoor device 1. A circumference of the pair of shrouds 90 may contact the side panels 31, the front panel 34, and the rear panel 32, respectively, so that all of the air passed through and heat-exchanged with the outdoor heat exchanger 55 may pass through the pair of shrouds 90 and may be guided to the pair of discharge ports 11.

According to an embodiment disclosed herein, a motor mount 72 may be provided at or in the pair of chassis frames 71. The motor mount 72 may extend across the pair of shrouds 90. A pair of motor mounts may be provided at at least one of the shrouds 90 to support both sides of a motor 82 of each fan motor assembly 80.

A size of each shroud 90 may correspond to the respective diameter of the respective fan 81 of the fan motor assembly 80. The fan 81 may be rotatably provided inside of the shroud 90. That is, the fan motor assembly 80 may be accommodated at the inside of the shroud 90.

Figure 7:
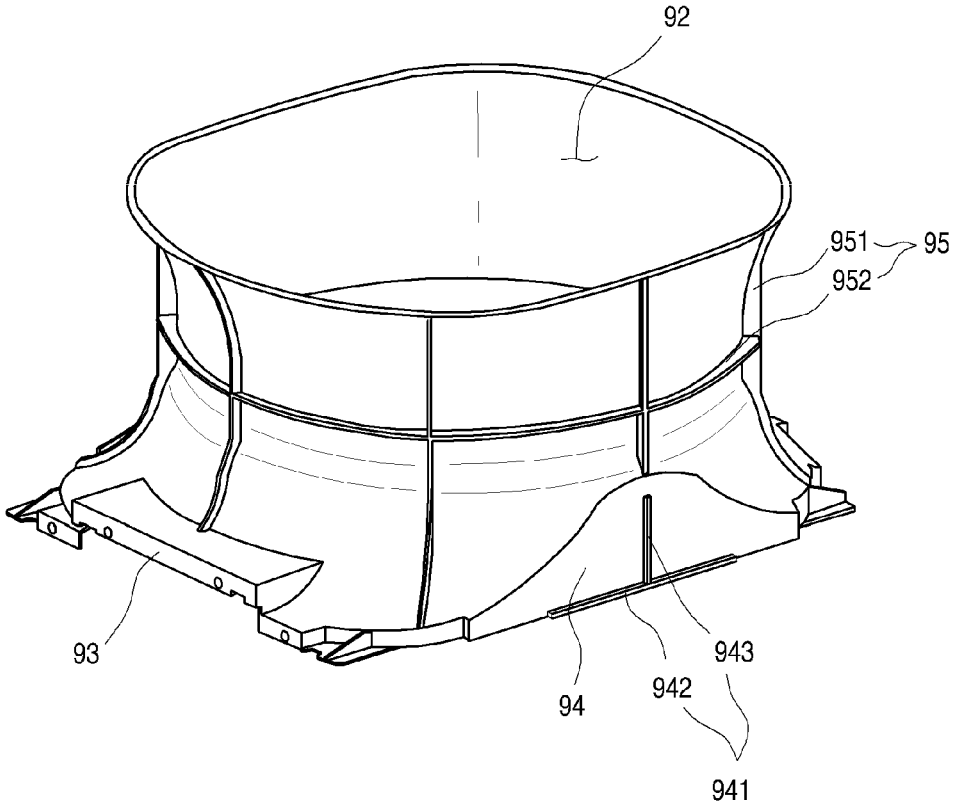
FIG. 7 is a perspective view of a shroud according to an embodiment.
Figure 8:
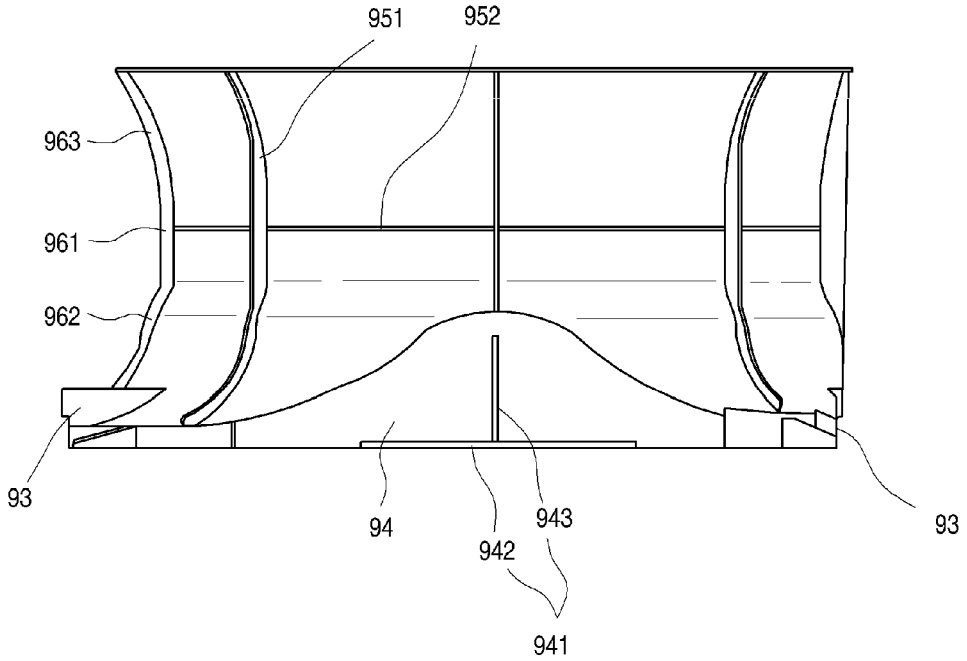
FIG. 8 is a side view of the shroud according to an embodiment.
Figure 9:
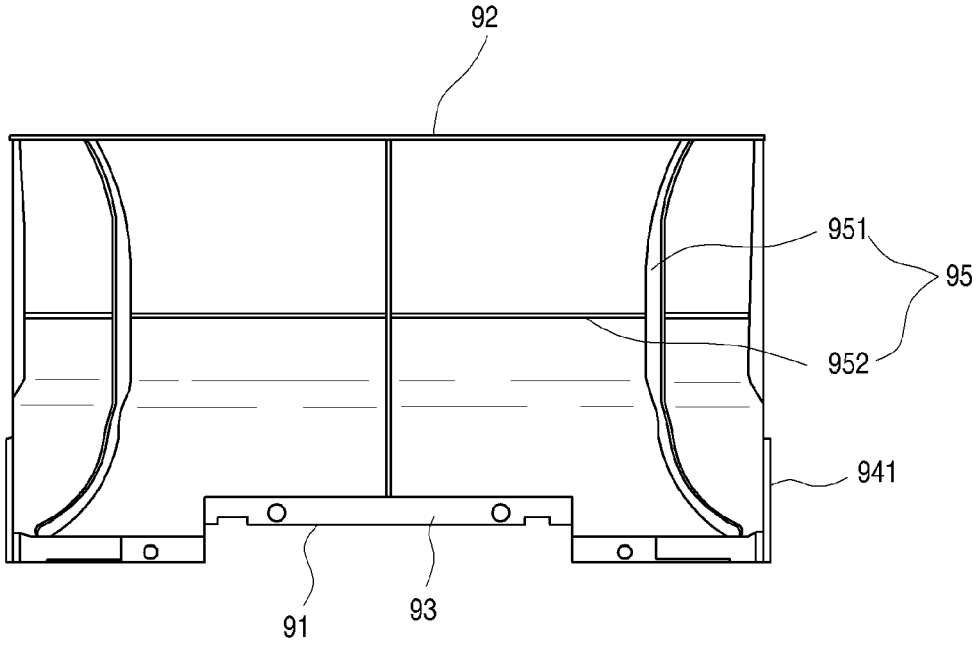
FIG. 9 is a front view of the shroud according to an embodiment.
Figure 10:
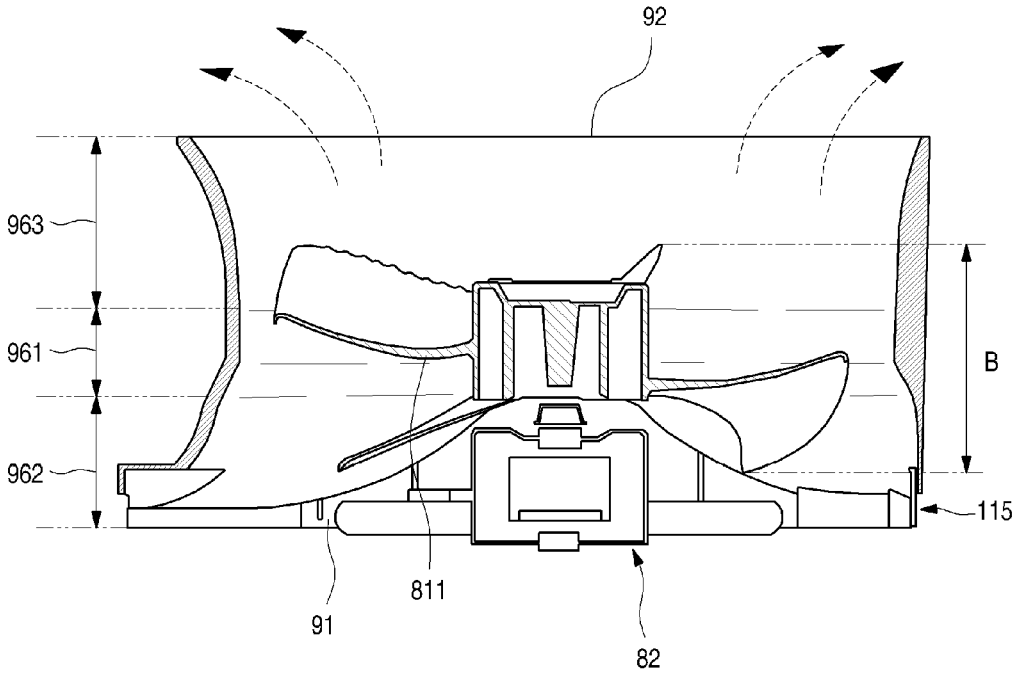
FIG. 10 is a cross-sectional view, taken along X-X' of FIG. 5.

FIG. 7 is a perspective view of a shroud according an embodiment disclosed herein. FIG. 8 is a side view of the shroud according to an embodiment. FIG. 9 is a front view of the shroud according to an embodiment. FIG. 10 is a cross-sectional view taken along X-X' of FIG. 5.

The shroud 90 may be in a bucket shape that opens in a vertical direction and may have a rectangular cross section if viewed from the front. A lower surface of the shroud 90 may also have a rectangular shape. If the pair of shrouds 90 are installed at or in the outdoor device 1, then the pair of shrouds 90 may have a shape that corresponds to a cross section of the outdoor device 1 and may enable air from a lower region of the outdoor device 1 to be effectively suctioned.

A shroud installation part or portion 93 may be formed at front and rear surfaces of the shroud 90. The shroud installation portion 93 may be coupled with or attached to the chassis frame 71 and may have a shape that corresponds to the chassis frame 71. The shroud installation portion 93 may allow a fastening member, for example, a screw, to pass through to couple with or attach to the chassis frame 71.

A side surface 94 may be formed at left and right or first and second sides of the shroud 90. The side surface 94 may be a surface that faces the side panel 31 or another adjacent shroud 90. The side surface 94 may be in a shape formed by vertically cutting a curved surface that forms an outer surface of the shroud 90. That is, to ensure a predetermined air volume, the shroud 90 may have a structure that expands as much as possible within a predetermined range that does not interfere with the outer panel or the other shroud 90 in the outdoor device 1.

A contraction part or contracted portion 962 of the shroud 90 may have a curved surface that gradually extends outward toward a bottom of the shroud 90. However, the side surface 94 may have a structure formed by vertically cutting the curved surface of the contracted portion 962 and may be in close surface contact with the side panel 31 and the other shroud 90.

The shroud 90 may not have a lateral expansion structure due to limited space, and thus, may have a surface contact area like the side surface 94 to secure the space. Accordingly, front and rear sides of the shroud 90 may expand or extend to where there may be an available space inside the outdoor device 1. Other portions than the left and right or first and second side surfaces of the shroud 90 may have curved surface shapes that expand.

A contact rib 941 may be provided to protrude at the side surface 94. The contact rib 941 may include at least two or more ribs, for example, a first contact rib 942 and a second contact rib 943 that cross each other.

The first contact rib 942 may be provided at a lower end of the side surface 94 and may be formed to extend in a horizontal direction of the side surface 94. The second contact rib 943 may vertically extend from a middle of the first contact rib 942 or a middle of a length in a horizontal direction of the shroud 90. The first contact rib 942 and the second contact rib 943 may contact each other and cross each other vertically.

The side surface 94, at which the contact rib 941 may be formed, may be located on an extension line with a side end of the outlet port 92. The contact rib 941 may protrude more than the side end of the outlet port 92. Thus, the shroud 90 may not interfere with the side panel 31 or the other shroud 90 via the contact rib 941.

When the shroud 90 is installed in the outdoor device 1, a first side surface part 94 may face an inner side surface of the side panel 31, and the contact rib 941 may be in contact with the side panel 31. A second side surface 94 of the shroud 90, for example, may face and be in contact with a side surface 94 of the adjacent shroud 90, as shown in FIG. 6. Thus, the contact ribs 941 of both shrouds 90 may be in close contact with each other.

If the pair of shrouds 90 are installed inside of the outdoor device 1, the shrouds 90 may be in close contact with each other as well as the side panels 31. The shrouds 90 may be in close contact with each other so that the contact rib 941 of each shroud 90 may press together. Thus, the pair of shrouds 90 may be kept stable and may also prevent vibration noise from occurring when the outdoor device 1 is operated. For example, if the contact rib 941 includes the first contact rib 942 and the second contact rib 943 that horizontally and vertically cross each other, contact between the contact ribs 941 that face each other may be maintained without dislocating, even when a vibration is generated as the outdoor device 1 operates.

FIG. 7 shows a first side surface 94 and a first contact rib 941 formed at a side of the shroud 90. However, a second and similar side surface 94 and a second and similar contact rib 941 may be provided at or on an opposite side of the shroud 90 than the first side surface 94 and the first contact rib 941.

A plurality of reinforcing ribs 95 may be provided at an outer surface of the shroud 90 to prevent vibration and deformation generated when the air passes through the shroud 90. That is, a plurality of vertical reinforcing ribs 951 formed from an inlet port 91 to the outlet port 92 may be provided at or on the shroud 90. The plurality of vertical reinforcing ribs 951 may be provided along a circumference of the shroud 90 at regular intervals and may extend from an upper end to a lower end of the shroud 90.

A horizontal reinforcing rib 952 may also be provided along the circumference of the shroud 90. The horizontal reinforcing rib 952 may cross the vertical reinforcing rib 951. A plurality of horizontal reinforcing ribs 952 may be provided and may be vertically provided at regular intervals. As air flows through the outdoor device 1, oscillations or vibrations of the shroud 90 may be prevented by the horizontal reinforcing rib 952 and the vertical reinforcing rib 951.

When viewed from an upper side of the shroud 90, at least a part or portion of a front half and a rear half of the outlet port 92 that connects left and right or first and second side ends of the shroud 90 may be formed to have a predetermined curvature. Due to the curvature, the shroud 90 may have a cross section that expands out more than a diameter of the fan 81.

That is, the shroud 90 may be formed so that its cross section may be gradually larger at a section or area at which the fan 81 is not located. Thus, a surface area of an opening of each of the inlet port 91 and the outlet port 92 located at the upper and lower portions of the shroud 90, respectively, may be expanded. As shown in FIG. 10, the shroud 90 may include a linear portion 961, side end portion 115, side end portion or contracted portion 962, and an expansion part or expanded portion 963 based on a height direction.

The linear portion 961 may be provided at or in a vertical rotational area B which may be occupied by a blade 811 of the fan 81 when the blade is rotated. The linear portion 961 may be a portion in which the diameter or a cross sectional area of the shroud 90 may be the smallest. The linear portion 961 may correspond to an outer diameter of the fan 81 to enable air to flow through the blade 811 when the fan 81 rotates in the shroud 90. The linear portion 961 may not extend vertically beyond the rotational area B of the fan 81 and may be located at a vertical midpoint of the rotational area B.

The contracted portion 962 may be provided from where the inlet port of the shroud 90 may be formed to a lower end of the linear portion 961. The contracted portion 962 may be formed so that its cross sectional area may be gradually reduced from the inlet port 91 of the shroud 90 toward the linear portion 961. That is, the cross sectional area of the contracted portion 962 may be greatest at the inlet port 91 of the shroud 90 and then may be gradually reduced upward. The contracted portion 962 may have a size that corresponds to a cross sectional area of the linear portion 961 at which the contracted portion 962 is in contact with the linear portion 961.

The expanded portion 963 may be provided from the linear portion 961 to an upper end of the outlet port 92. The expanded portion 963 may also be formed so that its cross sectional area may be gradually increased from an upper end of the linear portion 961 toward the outlet port 92 of the shroud 90. That is, the cross sectional area of the expanded portion 963 may be smallest at the upper end of the linear portion 961 and may gradually increase upward to be greatest at the outlet port 92 of the shroud 90. Thus, the expanded portion 963 may have a same horizontal size or circumference as a horizontal size or circumference of the discharge port 11 of the top cover 10.

Thus, an air pathway from the fan 81 to the outlet port 92 of the shroud 90 may gradually expand to account for a constant pressure of the air discharged from the fan 81. Accordingly, as shown in graphs in FIGS. 11 to 13, a flow rate of the discharged air may be increased, and noise may be reduced.

A cross sectional area of the shroud 90 may vary above and below the linear portion 961 but a transverse width that passes through a center of the shroud 90 may be equally maintained from the inlet port 91 to the outlet port 92. That is, the shroud 90 may not expand toward both side surfaces as that may interfere with the adjacent shroud 90 or the left and right or first and second side panels 31. Thus, the transverse width of the shroud 90, which passes the center of the shroud 90, may correspond to the diameter of the fan 81.

In a structure in which the pair of fans 81 may be transversely and adjacently provided, the outlet port 92 of the shroud 90 may expand, but positions of the fan motor assembly 80 and the discharge port 11 may be maintained. Further, the air pathway may be substantially expanded while a transverse length which passes through the center of the shroud may be maintained. Thus, the flow rate of air discharged from the outdoor device 1 may be increased by just changing a shape of the shroud 90 rather than other components or specifications of the outdoor device 1.

According to embodiments disclosed herein, when an air conditioner begins operating, a refrigerant may be compressed by the one or more compressor 51, and the compressed refrigerant may be circulated along the refrigeration cycle. When the air conditioner performs the cooling operation, the outdoor heat exchanger 55 may serve as the condenser, and air may forcibly flow to be heat-exchanged with the refrigerant passing through the outdoor heat exchanger 55.

The motor 82 may drive a rotation of the one or more fan 81 simultaneously with the one or more compressor 51. Air outside of the outdoor device 1 may be suctioned through surfaces of the outdoor device 1 by rotation of the one or more fan 81 and may pass through the outdoor heat exchanger 55. The air may then pass the one or more fan 81 while passing through the one or more shroud 90 and may be discharged to and out of the one or more discharge port 11.

For example, the air introduced into the outdoor device 1 and that has passed through the outdoor heat exchanger 55 may flow upward to be introduced into the inlet port 91 of the one or more shroud 90. The air introduced through the inlet port 91 may flow through the contracted portion 962 of the shroud 90 and may pass through the fan 81 located at a section of the linear portion 961 of the shroud 90. A plurality of the blades 811 of the fan 81 may be close to an inner side surface of the shroud 90, and the air may be discharged upward by the plurality of blades 811.

The air may pass through the plurality of blades 811 to flow upward through the expanded portion 963 of the shroud 90. As the expanded portion 963 may have a gradually increasing cross sectional area, the air may be smoothly discharged by compensating for a constant pressure. Thus, a flow rate of the discharged air may be increased, and noise may be reduced.

An air conditioner according to another embodiment may have a shroud that further expands, and front and rear half portions of the shroud may include a linear section and a curved section. Structures of the shroud and the discharge port of the air conditioner according to another embodiment may vary from the embodiment described above, whereas other features of the air conditioner may be similar or the same as the embodiment described above.

Figure 11:
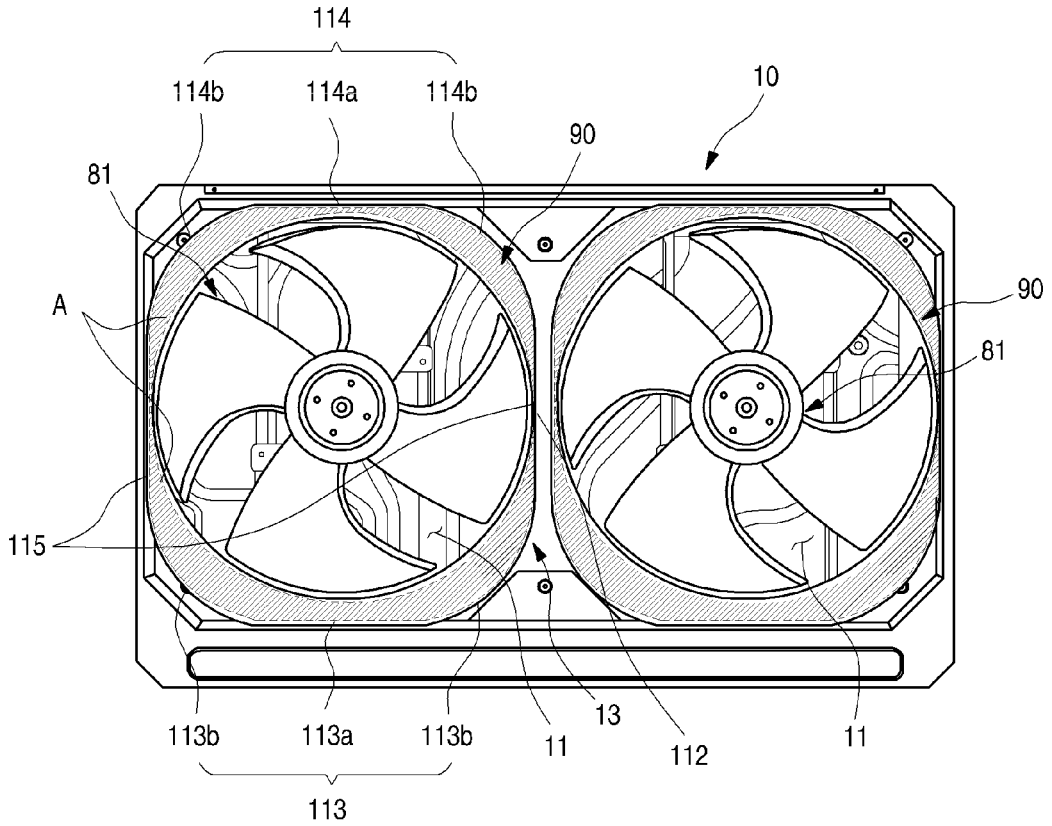
FIG. 11 is a plan view of an outdoor device of an air conditioner in which a discharge grille is removed according to another embodiment.
Figure 12:
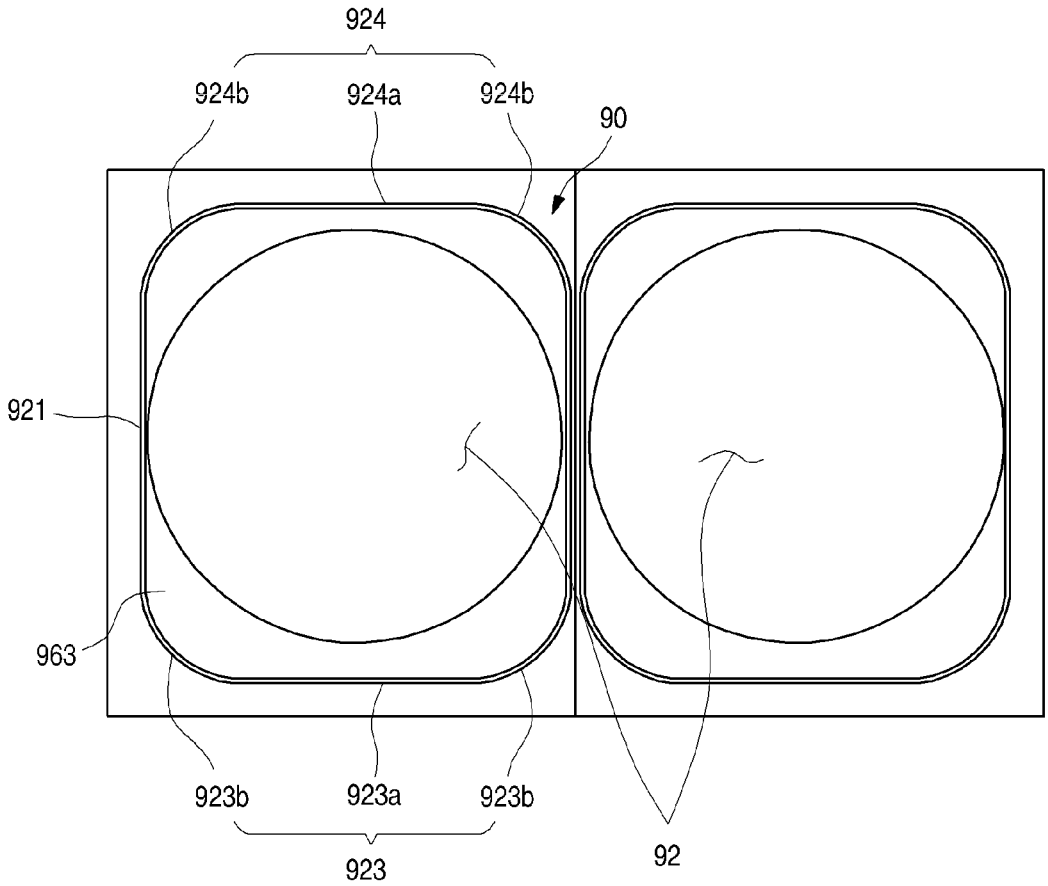
FIG. 12 is a plan view of a shroud according to another embodiment.

FIG. 11 is a plan view of an outdoor device of an air conditioner according to another embodiment in which a discharge grille outdoor device is removed. FIG. 12 is a plan view of a shroud according to another embodiment.

An upper surface of outdoor device 1 of an air conditioner according to another embodiment may be formed by top cover 10. Recessed portion 13 may be formed at or in the top cover 10, and a pair of discharge ports 11 may be formed in parallel at the recessed portion 13.

Each of the discharge ports 11 may be a same shape as outlet port 92 of shroud 90. Discharge port 11 may be formed close to a perimeter of the recessed portion 13 and an adjacent discharge port 11. A size of each of the discharge port 11 and the outlet port 92 of the shroud 90 may be formed to expand more than that of the previous embodiment.

For example, the discharge port 11 may have a side end 115 which may be formed at both left and right or first and second side surfaces to have a linear shape and a predetermined length. A front half 113 and a rear half 114 may connect to both ends of the side end 115 of the discharge port 11.

A first linear portion 113*a*, which may be in contact with a front end of the recessed portion 13, may be formed at the front half portion 113. A first rounded portion 113*b*, which may be connected with an end of the side end 115, may be formed at both ends of the first linear portion 113*a*.

A second linear portion 114*a*, which may be in contact with a rear end of the recessed portion 13, may also be formed at the rear half 114. A second rounded portion 114*b*, which may be connected with another end of the side end 115, may be formed at both ends of the second linear portion 114*a*.

That is, the first rounded portion 113*b* and the second rounded portion 114*b* may expand further outward to maximize a surface area of the discharge port 11. Thus, the first linear portion 113*a* and the second linear portion 114*a* may contact a perimeter of the recessed portion 13.

In a structure in which the recessed portion 13 is not formed, the first linear portion 113*a*, the second linear portion 114*a*, and the side end 115 of the discharge port 11 may be in contact with an outer side end of the top cover 10.

The shroud 90 may have expanded portion 963 that expands from linear portion 961 which may correspond to a diameter of fan 81 to the discharge port 11. The shroud 90 may have an expansion area A' that expands through the expanded portion 963 if viewed from an upper side of the outdoor device 1. Outlet port 92 of the shroud 90 may correspond to a size of the discharge port 11.

For example, the outlet port 92 may also have a linear-shaped shroud side end 921, which may be formed at both left and right or first and second side surfaces to have a predetermined length. The shroud side end 921 may extend to a position close to the side panel 31 of the outdoor device 1 and close to a side end 921 of an adjacent shroud 90.

A shroud front half 923 and a shroud rear half 924, which may connect both ends of the shroud side ends 921, may be formed. At least a portion of the shroud front half 923 and the shroud rear half 924 may be in contact with the outer panel or the recessed portion 13.

For example, the shroud front half 923 may include a first shroud linear portion 923*a* that extends to be in contact with a front end of a perimeter of the recessed portion 13. A first shroud rounded portion 923*b*, which may be rounded with a predetermined curvature and connected with the shroud side end 921, may be formed at both ends of the first shroud linear portion 923*a*.

The shroud rear half 924 may include a second shroud linear portion 924*a* that extends to be in contact with the rear panel 32. A second shroud rounded portion 924*b*, which may be rounded with a predetermined curvature and connected with the shroud side end 921, may be formed at each of both ends of the second shroud linear part 924*a*.

The expanded portion 963 of the shroud 90 may gradually expand toward the outlet port 92. The expanded portion 963 may expand to a maximum within a predetermined range so as to not interfere with the outer panel or the adjacent shroud 90. As the shroud 90 further expands, sections of the linear portions 923*a* and 924*a* may become longer, and the rounded portions 923*b* and 924*b* may further extend toward corners of the outdoor device 1.

Figure 13:
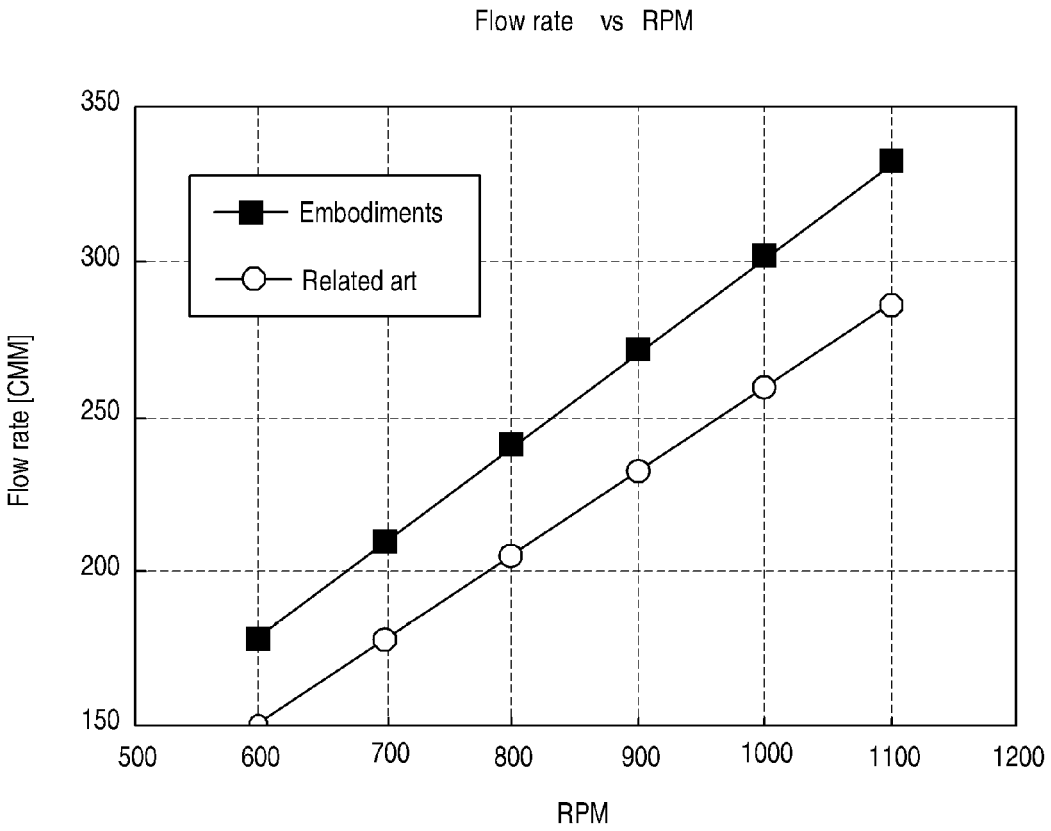
FIG. 13 is a graph of air volume flow rates versus RPM of a fan in the related art and a fan in the outdoor device for an air conditioner according to embodiments.
Figure 14:
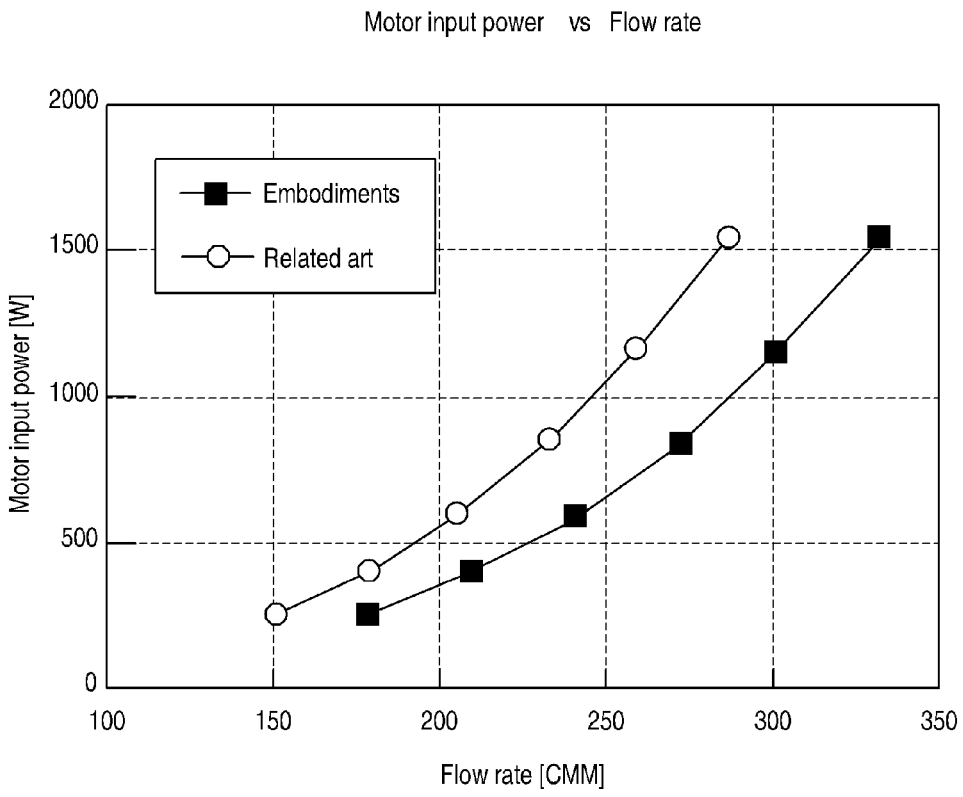
FIG. 14 is a graph of motor input power versus air volume flow rates of a motor in the related art and a motor in the outdoor device for an air conditioner according to embodiments.
Figure 15:
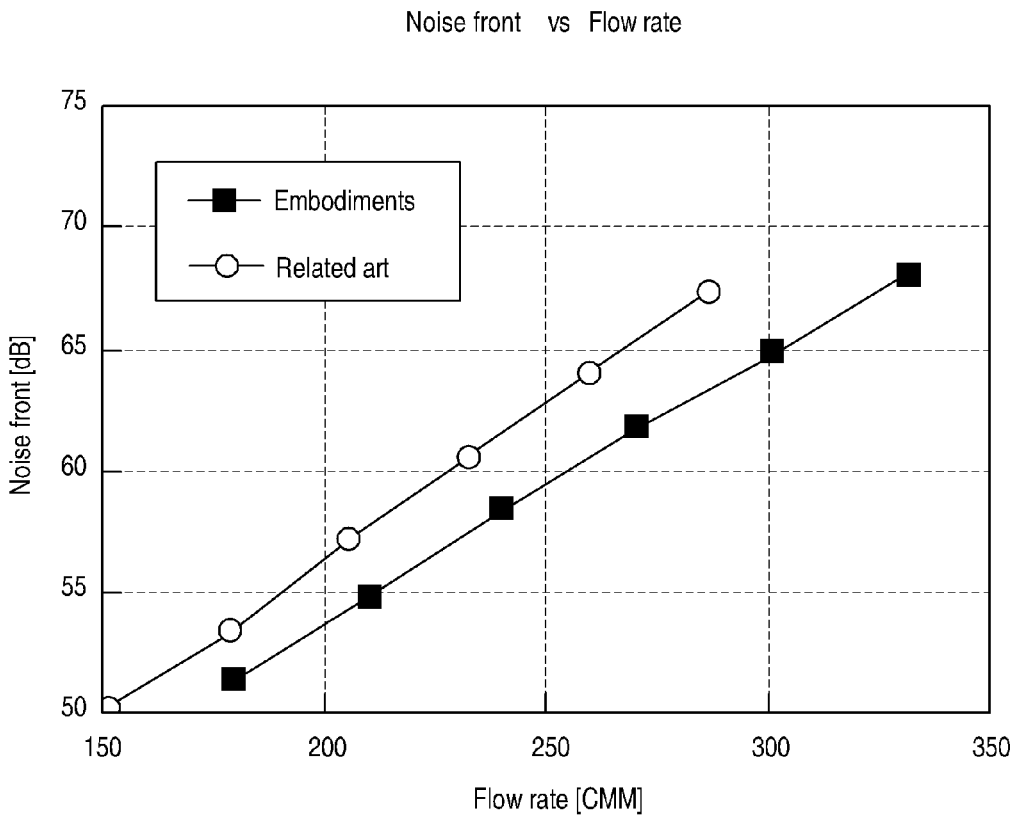
FIG. 15 is a graph of noise level versus air volume flow rates in the related art and in the outdoor device for an air conditioner according to embodiments.

FIG. 13 is a graph of air volume flow rates versus RPM of a fan in the related art and a fan in the outdoor device of an air conditioner according to embodiments. FIG. 14 is a graph of motor input power versus air volume flow rates of a motor in the related art and a motor in the outdoor device of an air conditioner according to embodiments. FIG. 15 is a graph of noise level versus air volume flow rates in the related art and in the outdoor device of an air conditioner according to embodiments.

FIGS. 13 to 15 compare data measured from an outdoor device of an air conditioner according to embodiments disclosed herein to an outdoor device of an air conditioner according to the related art with a shroud that has a same diameter from inlet port to outlet port. As shown in FIG. 13, when the outdoor device 1 according to the embodiments disclosed herein and the outdoor device of the related art are operated under a condition in which the RPM of the fan is the same, the outdoor device 1 according to the embodiments disclosed herein discharges more air than the outdoor device of the related art because of an improvement in air flow due to the expanded portion 963.

As shown in FIG. 14, when air volume changes according to a power value input to the motor to drive the fan as the outdoor devices are operated, the flow rate of the air discharged in the outdoor device 1 according to the embodiments disclosed herein is greater than that of the outdoor device of the related art. As shown in FIG. 15, when the noise level changes according to a change in air volume flow rate as the outdoor devices are operated, noise generated by the outdoor device 1 according to the embodiments disclosed herein is smaller than that by the outdoor device of the related art.

Thus, the outdoor device 1 according to embodiments disclosed herein may improve air flow due to the expanded portion 963 of the shroud 90, and the flow rate may be further increased and the noise generated may be further reduced than the flow rate and the noise generated by the related art.

According embodiments disclosed herein, it may be possible to compensate for a constant pressure of air discharged through a fan due to a shape of an expansion part or expanded portion of the shroud. Air flow may be improved, a flow rate of the discharged air may be increased, and noise may be reduced.

A shroud may have a structure in which its cross sectional area may gradually expand upward at only a front half and a rear half of the shroud, while a transverse width passing a center of the shroud may be maintained.

Thus, in structure in which fans are transversely and continuously provided, an outlet port of the shroud may be increased, but positions of a fan motor assembly and a discharge port may be maintained, and the flow rate of the discharged air may be maximally increased by changing only a shape of the shroud without a change in another structure, while the specification of the outdoor device may be maintained.

Contact ribs may be formed at left and right or first and second side surface parts or portions of the shroud, respectively. Thus, when the shroud is installed, a side panel and the shroud may be maintained in a close contact state. Also, a pair of adjacent shrouds may be in contact with each other in a state in which the contact ribs may be pressed to each other, and thus, vibration and oscillation may be prevented even when the outdoor device is operated. As the contact ribs may be vertically and horizontally formed, contact may be maintained without dislocation between the contact ribs, even when vibration may be generated during operation of the outdoor device, and thus, noise due to vibration and oscillation may be effectively prevented.

According to embodiments disclosed herein, an outdoor unit or device of an air conditioner is provided that may be able to compensate for a constant pressure of air passing through a fan, to increase a flow rate of the air, and also to reduce a noise.

An outdoor unit or device of an air conditioner according to embodiments disclosed herein may include a top cover configured to form an upper surface of the outdoor device and having a discharge port through which air may be discharged; a fan provided under the top cover; and a shroud configured to accommodate the fan and connected with the discharge port to guide a flow of the air. The shroud may be formed so that a transverse width thereof which passes centers of both side surfaces of the shroud and a center of the fan may be constantly maintained, and a cross sectional area thereof may be gradually increased toward the discharge port.

The shroud may be formed so that the cross sectional area thereof may be gradually increased from a position that corresponds to an upper portion of the fan to an outlet port of the shroud. Based on the centers of the both side surfaces of the shroud, a front half portion or front half and a rear half portion or rear half of the shroud may be gradually curved and expand outward toward upper sides thereof. A front half portion or front half and a rear half portion or rear half of the shroud toward corners of the top cover may be curved more than centers thereof.

The shroud may include a linear part or portion configured to form a space that accommodates the fan at an area between an upper end and a lower end of a blade of the fan, a contraction part or contracted portion configured to form a section from an inlet port of the shroud to the linear part and a cross sectional area of which may be gradually reduced toward the linear part, and an expansion part or expanded portion configured to form a section from the linear part to an outlet port of the shroud and a cross sectional area of which may be gradually increased toward the outlet port of the shroud.

A plurality of reinforcing ribs may be formed at a circumferential surface of the shroud to protrude outward, and the reinforcing ribs may include a vertical reinforcing rib configured to connect between the outlet port of the shroud and the inlet port thereof and disposed or provided along a circumference of the shroud to be spaced apart from each other at regular intervals, and a horizontal reinforcing rib disposed or provided along the circumference of the shroud to cross the vertical reinforcing rib.

A recessed portion which may be recessed along a perimeter of the outdoor device may be formed on the upper surface of the top cover, and the discharge port may be located inside of the recessed portion. A discharge grille configured to cover the discharge port may be installed at the recessed portion, and the discharge grille may be located under an upper end of the top cover.

The discharge port may be formed to have a diameter larger than a diameter of the fan and to be in contact with a plurality of points of a perimeter of the recessed portion.

According to another embodiment disclosed herein, an outdoor unit or device of an air conditioner may include a top cover configured to form an upper surface of the outdoor device, a plurality of fans disposed or provided under the top cover in parallel, a plurality of discharge ports formed at the top cover that corresponds to the plurality of fans, a plurality of shrouds configured to accommodate each of the plurality of fans and connected with the discharge ports to guide a flow of air. Each of the shrouds may have at least one or more linear section, which may be in contact with the adjacent shroud or a perimeter of the outdoor device, and may be formed so that a cross sectional area thereof may be gradually increased and expand toward the discharge port. The outdoor device may further include a plurality of chassis frames that couple to inner side surfaces of a front panel and a rear panel of the outdoor device to support the plurality of fans.

Each of the plurality of shrouds may include a shroud installation portion that may be formed at a front surface and a rear surface of the shroud and that may correspond with the chassis frames in order to couple to the chassis frames. Each of the shrouds may include a linear part or portion configured to form a space that accommodates the fan at an area between an upper end and a lower end of a blade of the fan, a contraction part or contracted portion configured to form a section from an inlet port of the shroud to the linear part and a cross sectional area of which may be gradually reduced toward the linear part, and an expansion part or expanded portion configured to form a section from the linear part to an outlet port of the shroud and a cross sectional area of which may be gradually increased toward the outlet port of the shroud.

A side surface part or side surface, which may be in a flat surface that faces and is in contact with a side surface of the outdoor device or one side surface of the adjacent shroud, may be formed at both side surfaces of the shroud.

A side surface part or side surface, which may be in contact with an out or outer panel that forms an outer surface of the outdoor device and the adjacent shroud, may be formed at both side surfaces of the shroud, and the side surface part may be formed so that a curved part or portion of the outer surface of the shroud has a cross section which may be in parallel with the outer panel.

A contact rib which may protrude more than an outer end of an outlet port of the shroud and may be in contact with a side surface of the outdoor device or the adjacent shroud may be further formed at the side surface part. The contact rib may include a first contact rib configured to extend in an extension direction of the shroud; and a second contact rib configured to extend to cross the first contact rib.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An outdoor device of an air conditioner, comprising:

a top cover that forms an upper surface of the outdoor device and provided with at least one discharge port through which air is discharged;

at least one fan provided under the top cover; and at least one shroud that accommodates the at least one fan and that communicates with the at least one discharge port, wherein the at least one fan is fully located within the at least one shroud, wherein the at least one shroud includes a linear portion that forms a space that accommodates the at least one fan at an area between an upper end and a lower end of a blade of the at least one fan and extends from an inlet portion including an inlet port to an expanded portion including an outlet port, wherein a transverse width of the at least one shroud that passes through left and right side surfaces of the at least one shroud and a center of the at least one fan is constant in the linear portion, wherein a cross sectional area of the expanded portion gradually increases toward the outlet port of the at least one shroud, and wherein, based on centers of the left and right side surfaces of the at least one shroud, a front half and a rear half of the at least one shroud are gradually curved and expand outward toward upper sides of the at least one shroud.

2. The outdoor device according to claim 1, wherein, based on centers of the left and right side surfaces of the at least one shroud, a front half and a rear half of the at least one shroud near corners of the top cover are curved more than the centers of the left and right side surfaces of the at least one shroud.

3. The outdoor device according to claim 1, wherein the inlet portion is a contracted portion that forms the inlet port of the at least one shroud and has a cross sectional area that gradually decreases upward toward the linear portion.

4. The outdoor device according to claim 1, wherein the at least one shroud further includes a plurality of reinforcing ribs provided at a circumferential surface of the at least one shroud that protrudes outward.

5. The outdoor device according to claim 4, wherein the plurality of reinforcing ribs include a plurality of vertical reinforcing ribs that connect the outlet port of the at least one shroud and the inlet port of the at least one shroud and are provided at regular intervals along a circumference of the shroud.

6. The outdoor device according to claim 5, wherein the plurality of reinforcing ribs further include a horizontal reinforcing rib provided along the circumference of the at least one shroud that crosses the plurality of vertical reinforcing ribs.

7. The outdoor device according to claim 1, further including a recessed portion along a perimeter of the outdoor device that is recessed on an upper surface of the top cover, wherein the at least one discharge port is provided in the recessed portion.

8. The outdoor device according to claim 7, further including a discharge grille that covers the at least one discharge port and is installed in the recessed portion.

9. The outdoor device according to claim 7, wherein the at least one discharge port has a diameter larger than a diameter of the at least one fan and contacts a perimeter of the recessed portion.

10. An air conditioner including the outdoor device according to claim 1.

11. An outdoor device of an air conditioner, comprising:

a top cover that forms an upper surface of the outdoor device;

a plurality of fans provided in parallel under the top cover;

a plurality of discharge ports provided in the top cover that correspond to the plurality of fans;

a plurality of shrouds that accommodate the plurality of fans, respectively, and that communicates with the plurality of discharge ports, wherein each of the plurality of shrouds includes at least one linear section that contacts an adjacent shroud, and another section having a cross sectional area that gradually increases towards a corresponding discharge port of the plurality of discharge ports.

12. The outdoor device according to claim 11, further including a plurality of chassis frames that couples to inner side surfaces of a front panel and a rear panel of the outdoor device to support the plurality of fans.

13. The outdoor device according to claim 12, wherein each of the plurality of shrouds includes a shroud installation portion formed at a front surface and a rear surface of the respective shroud and that corresponds with the plurality of chassis frames in order to couple to the plurality of chassis frames.

14. The outdoor device according to claim 11, wherein the cross sectional area of each of the plurality of shrouds includes:

a vertical linear portion that forms a space that accommodates the respective fan at an area between an upper end and a lower end of a blade of the respective fan;

a contracted portion that forms a section from an inlet port of the shroud to the vertical linear portion and has a cross sectional area that gradually decreases toward the vertical linear portion; and an expanded portion that forms a section from the vertical linear portion to an outlet port of the shroud and has a cross sectional area that gradually increases toward the outlet port of the shroud.

15. The outdoor device according to claim 11, wherein each of the plurality of shrouds includes a side surface provided at two side surfaces of the shroud and including a flat surface that faces and contacts a side surface of the outdoor device or a side surface of the adjacent shroud.

16. The outdoor device according to claim 11, wherein each of the plurality of shrouds includes a side surface provided at two side surfaces of the shroud and that contacts with the adjacent shroud and an outer panel that forms an outer surface of the outdoor device.

17. The outdoor device according to claim 16, wherein the side surface is formed so that a curved portion of an outer surface of the shroud has a cross section that is in parallel with the outer panel.

18. The outdoor device according to claim 16, wherein the side surface includes a contact rib that protrudes further than an outer end of an outlet port of the shroud and contacts a side surface of the outdoor device or the adjacent shroud.

19. The outdoor device according to claim 18, wherein the contact rib includes a first contact rib that extends in a horizontal direction of the shroud and a second contact rib that crosses the first contact rib.

20. An air conditioner including the outdoor device according to claim 11.

21. An outdoor device of an air conditioner, comprising:

a top cover and provided with at least one air discharge port;

at least one fan provided under the top cover; and at least one shroud that accommodates the at least one fan and that communicates with the at least one air discharge port, wherein the at least one shroud includes:

a linear portion that accommodates the at least one fan at an area between an upper end and a lower end of a blade of the at least one fan;

a contracted portion that forms an inlet port of the at least one shroud and includes a cross sectional area that gradually decreases upward toward the linear portion; and an expanded portion that forms an outlet port of the at least one shroud and includes a cross sectional area that gradually increases upward from the linear portion, wherein the at least one fan is fully located within the at least one shroud, wherein a transverse width of the at least one shroud that passes through the linear portion of the at least one shroud and a center of the at least one fan is constant, and wherein the at least one shroud includes a side surface provided at two side surfaces of the at least one shroud and including a flat surface that faces and contacts a side surface of the outdoor device or contacts a side surface of an adjacent shroud if more than one shroud is provided.

22. The outdoor device according to claim 21, wherein the at least one shroud includes a plurality of vertical reinforcing ribs that connects the outlet port of the at least one shroud and the inlet port of the at least one shroud and provided at regular intervals along a circumference of the shroud.

23. The outdoor device according to claim 22, wherein the at least one shroud further includes a plurality of horizontal reinforcing ribs provided along the circumference of the at least one shroud that crosses the plurality of vertical reinforcing ribs.

24. The outdoor device according to claim 21, wherein the side surface includes a contact rib that protrudes further than an outer end of the outlet port of the at least one shroud and contacts the side surface of the outdoor device or the adjacent shroud.

25. The outdoor device according to claim 24, wherein the contact rib includes a first contact rib that extends in a horizontal direction of the at least one shroud and a second contact rib that crosses the first contact rib.

26. An air conditioner including the outdoor device according to claim 21.

* * * * *